US005184908A

United States Patent [19]

Yamamoto et al.

[11] Patent Number: 5,184,908

[45] Date of Patent: Feb. 9, 1993

[54] WRITING IMPLEMENT WITH SIDE ACTUATOR

[75] Inventors: Tadashi Yamamoto; Shuhei Kageyama; Takahiko Suzuki, all of Kawagoeshi, Japan

[73] Assignee: Kotobuki & Co., Ltd., Kyoto, Japan

[21] Appl. No.: 902,973

[22] Filed: Jun. 23, 1992

Related U.S. Application Data

[63] Continuation of Ser. No. 618,499, Nov. 17, 1990, abandoned.

[51] Int. Cl.[5] ..... B43K 27/00; B43K 27/12; B43K 24/04

[52] U.S. Cl. ..... 401/29; 401/31; 401/99; 401/109; 401/110; 401/111

[58] Field of Search ..... 401/29, 31, 109, 110, 401/111, 99

[56] References Cited

U.S. PATENT DOCUMENTS

| | | | |
|---|---|---|---|
| 387,042 | 7/1888 | Bohren | 401/110 X |
| 3,051,132 | 8/1962 | Johmann | 401/110 X |
| 3,079,894 | 3/1963 | Johmann | 401/31 |
| 3,137,276 | 6/1964 | Weisser . | |
| 3,144,005 | 8/1964 | Johmann | 401/110 X |
| 3,205,863 | 9/1965 | Rhoades | 401/111 |
| 3,288,115 | 11/1966 | Hechtle . | |

FOREIGN PATENT DOCUMENTS

| | | | |
|---|---|---|---|
| 821011 | 11/1951 | Fed. Rep. of Germany | 401/31 |
| 1129399 | 5/1962 | Fed. Rep. of Germany | 401/111 |
| 1461616 | 4/1969 | Fed. Rep. of Germany | 401/34 |
| 3705097 | 9/1987 | Fed. Rep. of Germany | 401/99 |
| 615636 | 7/1961 | Italy | 401/103 |

*Primary Examiner*—Steven A. Bratlie
*Attorney, Agent, or Firm*—David O'Reilly

[57] ABSTRACT

A writing tool comprised of a head member, a refill, a return spring, and a cam mechanism for projecting the top of the refill out of or retracting it into the head member comprised of cam body, a rotation cam, and cam bar. The cam body is attached to the head member, and the rotation cam is located near the head member. Since the cam mechanism is located near the head member, the length of the writing tools may be short, therefore compact small writing tools can be formed.

7 Claims, 4 Drawing Sheets

WRITING IMPLEMENT WITH SIDE ACTUATOR

CROSS-REFERENCE TO RELATED APPLICATIONS

This application is a continuation of applicant's copending patent application Ser. No. 07/618,499 filed Nov. 17, 1990 now abandoned.

FIELD OF THE INVENTION

The present invention relates to writing tools including a mechanical pencil and a ball-point pen, and more particularly to writing tools in which the tip of a refill can be projected out of the end of a head member of a writing tool by a knocking action and can be retracted into the head member by a knocking action.

BACKGROUND OF THE INVENTION

A conventional writing tool, for example, as shown in FIG. 8, and FIGS. 9(*a*) and (*b*), has a rotation cam mechanism for projecting the tip of a refill for a ball-point pen out of, or retract it into the head member (not shown) of the writing tool, which comprises cam body 1 attached on the inside of the rear portion of outer sleeve 10 connected with the head member, rotation cam 2 engaged with cam body 1 or released from cam body 1, and cam bar 3 for pushing rotation cam 2. Refill 5 for a ball-point pen is inserted into outer sleeve 10. A return spring (not shown) is provided between a step-shaped bearing portion (not shown) formed on the inside of the head member and a bearing portion (not shown) of refill 5 for retracting ball-point pen refill 5.

Cam body 1 has some, say three, axial projecting strips 25 arranged at regular angular intervals on the inside thereof, each projecting strip 25 having a shallow groove 26*a* shaped and having a root 27 at an edge thereof. Deep grooves 26*b* are formed between respective projecting strips 25.

Ball-point pen refill 5 has rotation cam 2 fitted in a rear portion thereof. Rotation cam 2 has on the outside thereof three axial projecting strips 34 which fit in deep grooves 26*b* of cam body 1. Strips 34 are made to form a crown which has peaks 35 and roots 36 alternately on an end of the cylindrical portion of rotation cam 2.

Cam bar 3 has six axial strips 30 on an outside thereof, which are fitted into deep grooves 26*b* of cam body 1. Strips 30 are made to form a crown which has peaks 31 and roots 32 on an end of the cylindrical portion of cam body 1. Cam bar 2 projects out of the rear end of outer sleeve 10.

Cam bar 3 can be pressed in opposition to the return spring. Rotation cam 2 and ball-point pen refill 5, then, can be pressed in opposition to the return spring where the slopes of peaks 35 of rotation cam 2 are fitted to, but deviated a little from, slopes of peaks 31 of cam bar 3. Strips 34 of rotation cam 2 fit into deep grooves 26*b* of cam body 1 (FIG. 9(*a*)). Stripes 34 of rotation cam 2, then, can be detached from deep grooves 26*b* of cam body 1 as follows. In the state shown in FIG. 9(*b*), the return spring presses the slopes of peaks 35 of rotation cam 2 to the slopes of peaks 31 of cam bar 3. This can revolve rotation cam 2 to make respective peaks 35 fit into respective roots 32. In turn, the slopes of peaks 35 of rotation cam 2 press the slopes of roots 27 of cam body 1 to further revolve rotation cam 2. The respective peaks 35 of the cylindrical cam 2, then can fit with respective roots 27 of cam body 1 as shown in FIG. 9(*b*). The tip of ball-point pen refill 5, thus, can be held projected out of the head member.

In the state shown in FIG. 9(*b*), when cam bar 3 is pressed again in opposition to the return spring, rotation cam 2 and ball-point pen refill 5 can be pressed in opposition to the return spring where the slopes of respective peaks 35 of rotation cam 2 are fitted to, but deviated a little from, the slopes of respective peaks 31 of cam bar 3. This detaches peaks 35 of rotation cam 2 to allow turning, which in turn allows peaks 35 and roots 36 of rotation cam 2 to fit respective peaks 31 and roots 32 of cam bar 3. In turn, the force of the return spring makes the slopes of peaks 35 of rotation cam 2 press the slopes of respective roots 27 of cam body 1 to turn rotation cam 2. The strips 34 of rotation cam 2, then, can be pressed in the respective grooves 26*b* of cam body 1 as shown in FIG. 9(*a*). This allows cam bar 3 to be retracted. At the same time, the tip of ball-point pen refill 5 is drawn into the head member.

However, since the cam mechanism is mounted in the rear portion of the outer sleeve, the length of a writing tool is long, therefore it is impossible to form compact small writing tools. Further it is impossible to form writing tools having two head members which are attached to both ends of an outer sleeve in which it is possible to project the tips of refills out of or retract them into both head members.

SUMMARY OF THE INVENTION

Accordingly, it is one object of the present invention to provide writing tools which have a smaller length, and makes it possible to form writing tools having two head members attached to both ends of an outer sleeve in which it is possible to project the tips of refills out of or retract them into both head members.

The object of the present invention is accomplished by writing tools comprised of a head member, a refill, a return spring, and a cam mechanism for projecting the tip of the refill out of or retracting it into the head member comprised of a cam body, a rotation cam, and cam bar, wherein said cam body is attached to the head member, and said rotation cam is located near the head members.

In the present invention, head member 6 can be attached to an outer sleeve 10. Cam bar 3 has control means 13 for controlling cam bar 3 placed on an outer surface and/or a rear end of cam bar 3. Outer sleeve 10 has an axial hole 11 into which a part of control means 13 is slidably inserted in axial hole 11 in an axial direction. Control means 13 is attached to the outer surface of cam bar 3. Cam bar 3 can have sleeve 12 placed on a rear end thereof to which control means 13 is connected, wherein a part of control means 13 is slidably inserted into axial hole 11 to be slidable in an axial direction. Rotation cam 2 may be integral with the refill 5.

Further, in the present invention, rotation cam 2 can have cavity 18 engaged with one end portion of refill 5 wherein an air vent 19 opens toward the cam bar, and the cam bar has an air vent opened toward outer air.

The above-mentioned object of the present invention is achieved by writing tools comprised of first and second head members 6, 6, outer sleeve 10 having first and second axial holes 11, 11 near two end portions thereof, first and second refills 5, 5 contained in first and second head members 6, 6, outer sleeve 10, and first and second return springs 9, 9. First and second cam mechanisms for projecting the tips of first and second refills 5, 5 out of or retracting them into first and second head member 6, 6, respectively comprise cam bodies 1, 1, rotation cams 2, 2, and cam bars 3, 3. First and second control means for controlling the cam bars of the first and second cam mechanisms are provided, wherein cam body 1 of the first cam mechanism is attached to first head member 6 and rotation cam 2 of the first cam mechanism is located near first head member 6, while cam body 1 of the second cam mechanism is attached to second head member 6 and rotation cam 2 of the second cam mechanism is located near second head member 6. Cam bar 3 of the first cam mechanism has first sleeve 12 placed on a rear end thereof to which control means 13 is connected, a part of the control means being inserted into first axial hole 11 so as to be slidable in an axial direction, while cam bar 3 of the second cam mechanism has second sleeve 12 placed on one end thereof to which second control means 13 is connected, a part of said second control means being inserted into second axial hole 11 so as to be slidable in an axial direction.

According to the present invention, since the cam mechanism is located near the head member, the length of the writing tool is shorter than conventional writing tools, therefore it is possible to form compact small writing tools.

In the present invention, "refill" means a refill for a ball-point pen, refill for mechanical pencil, refill for pencil-shaped eraser, and others.

BRIEF DESCRIPTION OF THE DRAWING

The above and other features of the invention will be more fully understood from the following detailed description and the accompanying drawings in which.

DETAILED DESCRIPTION OF THE INVENTION

Figure 1:
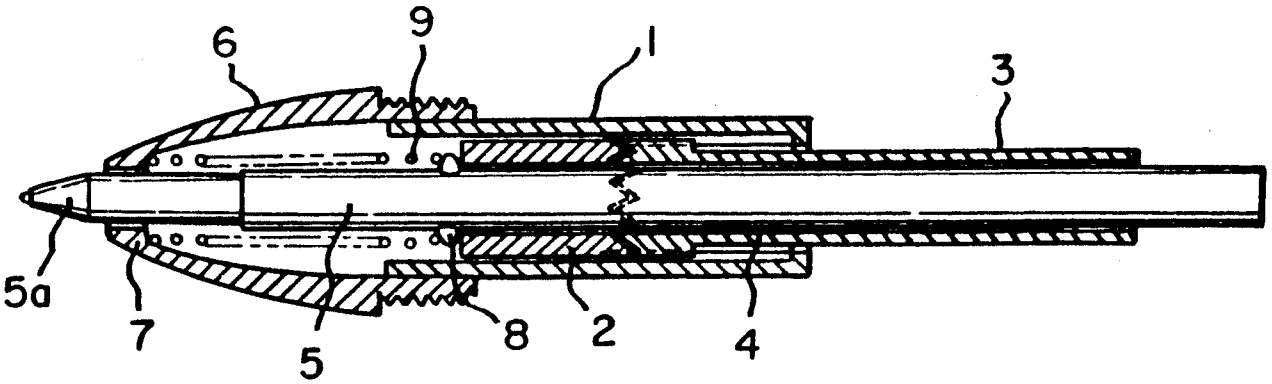
FIG. 1 is a sectional view of a first embodiment of a writing tool according to the present invention.
Figure 8:
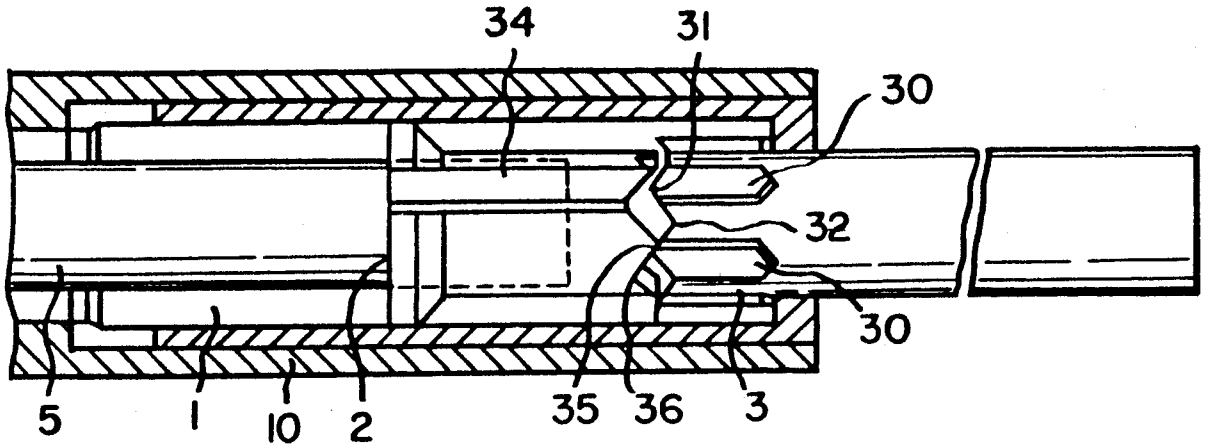
FIG. 8 PRIOR ART
FIG. 8 is a sectional view of a cam mechanism of conventional writing tools.
Figure 9B:
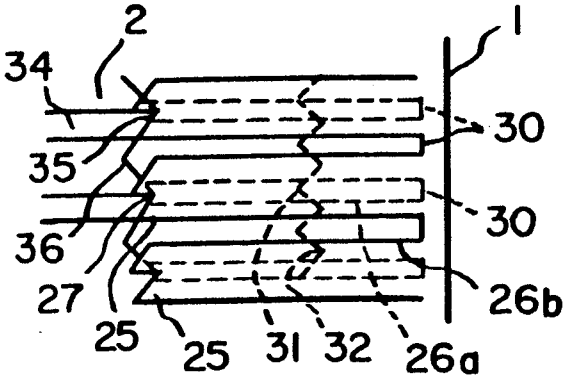
FIG. 9(b) PRIOR ART
FIGS. 9(*a*) and (*b*) are exploded views, FIG. 9(*a*) showing the relation of positions of a cam body, rotation cam, and cam bar, when the rotation cam is released from the cam body, and FIG. 9(*b*) showing the relation of positions of a cam body, rotation cam, cam bar, when the rotation cam is held by the cam body.
Figure 9A:
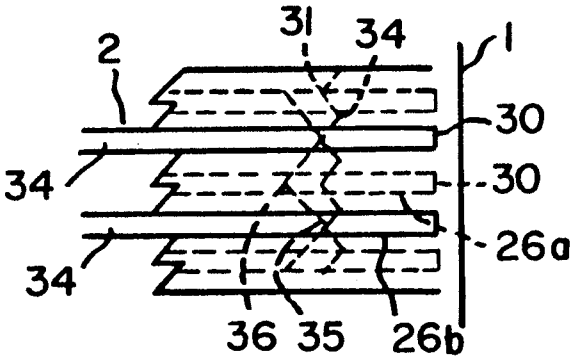
FIG. 9(a) PRIOR ART

Referring to FIG. 1, a writing tool of a first embodiment according to the present invention comprises head member 6, and cam body 1 inserted into head member 6. Rotary cam 2 and cam bar 3 engage rotation cam 2 and are mounted in cam body 1 in such a manner that the rear part of cam bar 3 projects out of cam body 1. Cam body 1, rotation cam 2, and cam bar 3 constitutes a known rotary cam mechanism as illustrated in FIGS. 8, 9(*a*) and (*b*).

Ball-point pen refill 5 is inserted through holes 4 of rotation cam 2 and cam bar 3. Head member 6 is attached to cam body 1 by means for engaging, screwing, or retaining head member 6 with cam body 1 or other suitable means. Return spring 9 for pulling ball-point pen refill 5 back is mounted between step-shaped bearing portion 7 of head member 6 and bearing portion 8 of ball-point pen refill 5.

In the first embodiment, when cam bar 3 is knocked against return spring 9 for pulling ball-point pen refill 5 back, rotation cam 2 engaging cam bar 3 is rotated by a desired angle to engage with cam body 1 so that ball-point pen refill 5 is maintained at a relative position with a pen point 5*a* of ball-point pen refill 5 projected out of head member 6. When cam bar 3 is again knocked, engagement of rotation cam 2 with cam body 1 is released, thereby rotation cam 2, cam bar 3 and ball-point pen refill 5, moves backward by spring force of return spring 9 for pulling ball-point pen refill 5 back so that pen point 5*a* is drawn into head member 6.

Since the first embodiment of the present invention has a structure in which head member 6 is attached to cam body 1 with rotation cam 2 and cam bar 3 inserted through return spring 9 for pulling ball-point pen refill 5 back, the writing tool of the present invention has a shorter axial length than normal so that a compact small writing tool can be formed.

Figure 2:
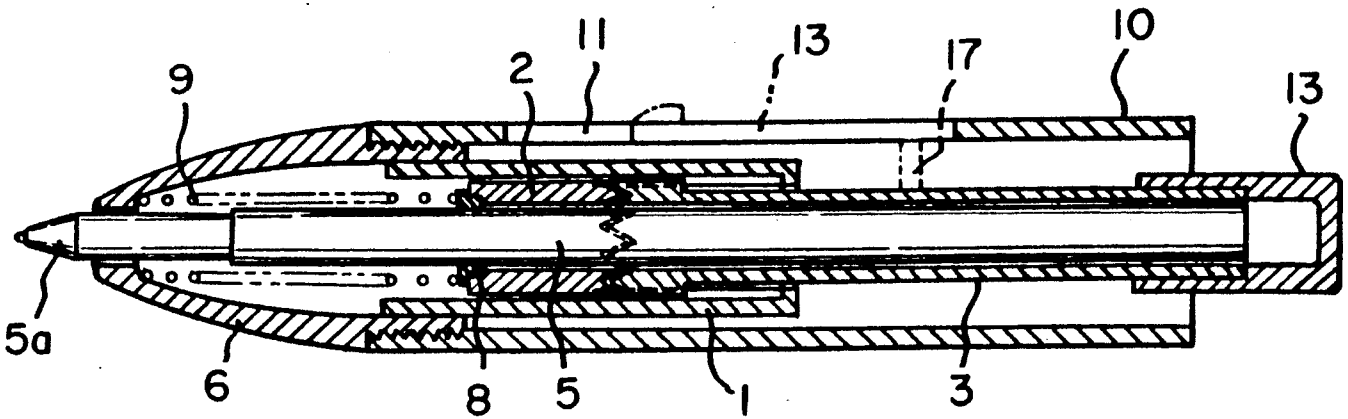
FIG. 2 is a sectional view of a second embodiment of a writing tool according to the present invention.

FIG. 2 is a sectional view of a second embodiment according to the present invention.

The writing tool of the second embodiment has the same structure as the first embodiment except that outer sleeve 10 is attached to head member 6 by means for engaging, screwing, or retaining head member 6 on cam body 1 or other suitable means and includes control means 13 attached to an end portion of cam bar 3 projecting out of the rear end of outer sleeve 13. Pen point 5*a* can be extended and retracted by knocking control means 13.

Further, in the second embodiment, outer sleeve 10 has axial hole 11 for sliding control means 13 attached to cam bar 3 through projection 17 which is an integral part of control means 13. Furthermore, the writing tool can be provided with both one control means 13 attached to an end portion of cam bar 3 and another control means 13 attached to a side of cam bar 3 through projection 17.

Figure 3:
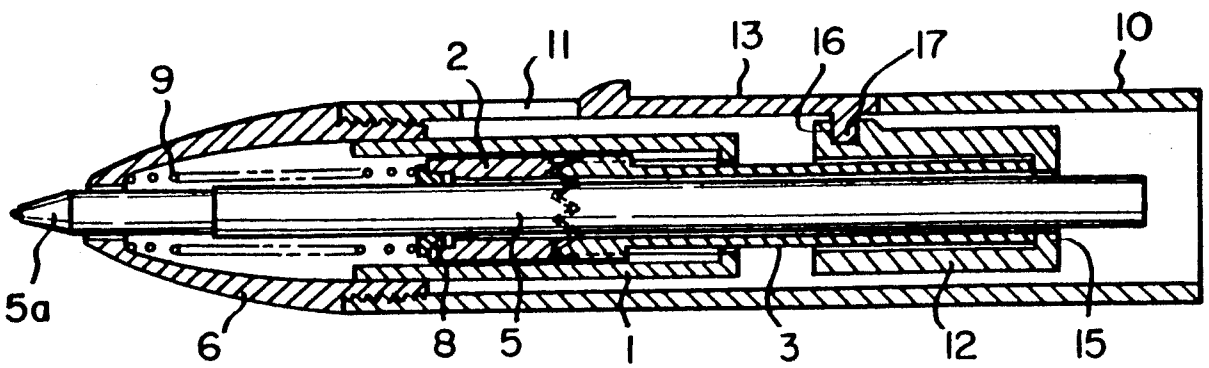
FIG. 3 is a sectional view of a third embodiment of a writing tool according to the present invention.

FIG. 3 is a sectional view of a third embodiment of the present invention.

The writing tool of the third embodiment has the same structure as the first embodiment except that outer sleeve 10 is attached to head member 6 by means for engaging, screwing, or retaining of head member 6 on cam body 1 or other suitable means, and the outer sleeve has an axial hole 11 for sliding control means 13 attached to sleeve 12 by projection 17 which is an integral part of control means 13. Sleeve 12 has holding part 16 and is brought to bear on an end of cam bar 3.

In the third embodiment, when control means 13 is moved in an axial direction against return spring 9 for pulling ball-point pen refill 5 back, sleeve 12 and cam bar 3 engaged with the sleeve are moved forward, then rotation cam 2 engaged with cam bar 3 turns by a desired angle whereby rotation cam 2 engages cam body 1 so that ball-point pen refill 5 is maintained at a relative position with a pen point 5*a* of ball-point pen refill 5 projected out of head member 6.

When control means 13 is again moved in an axial direction, engagement of rotation cam 2 with cam body 1 is released, allowing cam bar 3 and ball-point pen refill 5 to move backward by the spring force of return spring 9 for pulling ball-point pen refill 5 back so that pen point 5*a* is drawn into head member 6.

Figure 4:
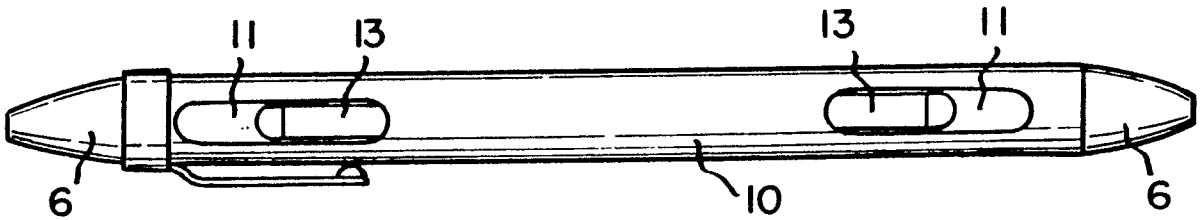
FIG. 4 is a side view of a fourth embodiment of a writing tool according to the present invention.

FIG. 4 is a side view of a fourth embodiment. Writing tool of the fourth embodiment comprises first and second head members 6, 6, an outer sleeve 10 having first and second axial holes 11, 11 near two end portions thereof, first and second refills 5, 5 contained in the first and second head members 6, 6 and outer sleeve 10, and first and second return springs 9, 9. First and second cam mechanisms for projecting pen-points 5*a* of the first and second refills 5, 5 out of or retracting them into first and second head members 6, 6, respectively comprise cam bodies 1, 1, rotation cams 2, 2, and cam bars 3, 3. First and second control means for controlling the cam bars of the first and second mechanisms are provided, wherein cam body 1 of the first cam mechanism is attached to first head member 6 and rotation cam 2 of the first cam mechanism is located near first head member 6, while cam body 1 of the second cam mechanism is attached to second head member 6 and rotation cam 2 of the second cam mechanism is located near second head member 6. Cam bar 3 of the first cam mechanism has first sleeve 12 placed on a rear end thereof to which control means 13 is connected, a part of the control means being inserted into the first axial hole to be slidable in an axial direction, while cam bar 3 of the second cam mechanism has second sleeve 12 placed on one end thereof to which second control means 13 is connected, a part of said second control means being inserted into the second axial hole to be slidable in an axial direction.

According to the fourth embodiment, writing tools of the side knocking type can be produced in which it is possible to project two pen-points 5*a* of ball-point pen refills 5 out of or retract them into both head members 6 provided on both sides of writing tools.

Figure 5:
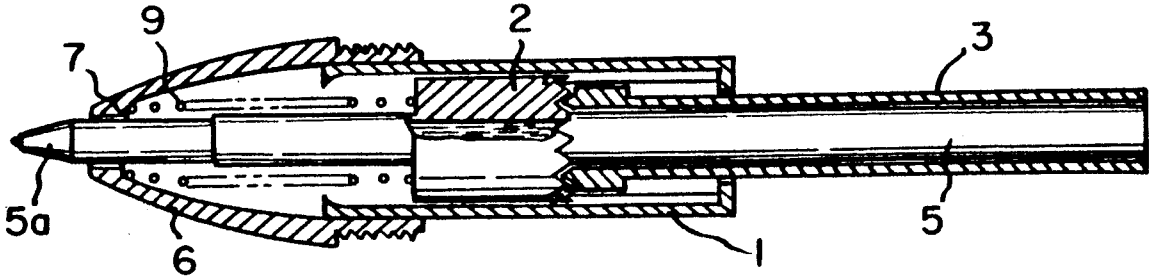
FIG. 5 is a sectional view of a fifth embodiment of a writing tool according to the present invention.

FIG. 5 is a sectional view of the fifth embodiment. The fifth embodiment has the same structure as the first embodiment except that rotation cam 2 is formed integrally with ball-point pen refill 5. Return spring 9 is inserted between a bearing portion of the head member and the rotation cam.

Figure 6:
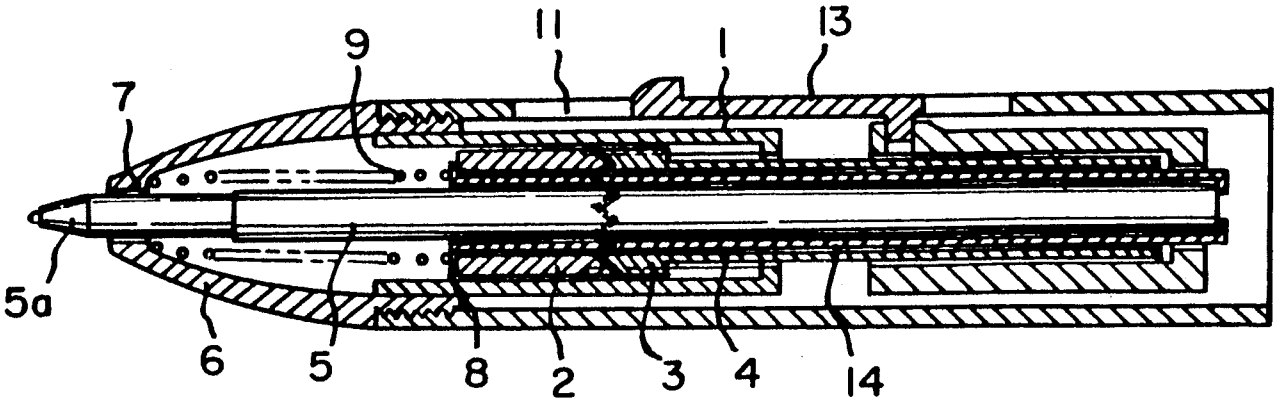
FIG. 6 is a sectional view of a sixth embodiment of a writing tool according to the present invention.

FIG. 6 is a sixth embodiment. The sixth embodiment has the same structure as the first embodiment except that bearing portion 8 for ball-point pen refill 5 and reinforcing sleeve 14 adhering to ball-point pen refill 5 are formed as one piece. Further rotation cam 2 is formed integrally with the reinforcing sleeve. In this embodiment, return spring 9 is inserted between stepped portion of head member 6 and the bearing portion 8 of reinforcing sleeve 14.

Figure 7:
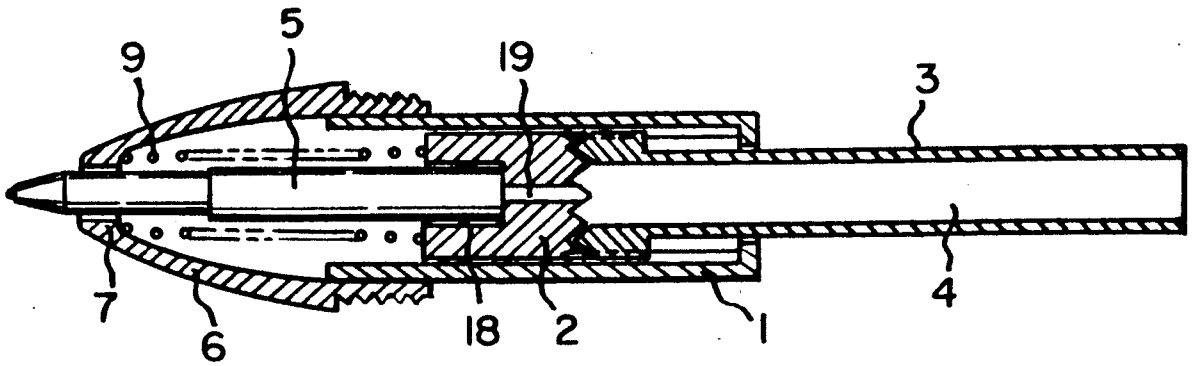
FIG. 7 is a sectional view of a seventh embodiment of a writing tool according to the present invention.

FIG. 7 is a sectional view of the seventh embodiment. The seventh embodiment has the same structure as the first embodiment except that rotation cam 2 has a cavity coaxial with rotation cam 2, which engages one end portion of refill 5, an air vent 19 opens toward cam bar 3, and the cam bar has an air vent opened toward outer air.

This invention is not to be limited by the embodiment shown in the drawings and described in the description, which is given by way of example and not of limitation, but only in accordance with the scope of the appended claims.

What is claimed is:

1. A writing tool comprising; an outer sleeve; a head member detachably connected to one end of said outer sleeve; writing refill means axially inserted in said head member and said outer sleeve; return spring means between bearing stops on said writing refill means and a bearing surface on interior of said head member; cam mechanism means for projecting or retracting the tip of said writing refill means from the end of said head member, said cam mechanism means comprising; a cam body attached to the end of said head member opposite said tip, rotatable cam means inside said cam body surrounding said writing refill means and abutting said bearing stops on said writing refill means, rotation cam bar means for rotating said rotatable cam means surrounding said writing refill means, said rotation cam bar means having a short portion inside said cam body engaging said rotatable cam means, and an elongate cylindrical sleeve portion extending beyond the end of said cam body; said rotatable cam means and said rotation cam bar means being retained in said cam body by a shoulder on one end of said cam body and said bearing stops on said writing refill means; an elongate axial hole in the side of said outer sleeve near said head member and adjacent said cam body; cam bar actuating means slidably mounted in said elongate axial hole; connecting means connecting said cam bar actuating means to said elongate cylindrical sleeve portion of said rotation cam bar means for actuating said rotation cam bar means to extend or retract the tip of said writing refill means; whereby said cam mechanism means is built into said head member so that a writing tool may be short in length.

2. The writing tool according to claim 1 including; sleeve means fitting over the end of said elongate cylindrical sleeve portion of said rotation cam bar means; said actuating means being connected to said sleeve means for operating said rotation cam bar means.

3. The writing tool according to claim 2 in which said rotatable cam means is an integral part of each of said refill means.

4. The writing tool according to claim 1 in which said rotatable cam means is an integral part of said refill means.

5. The writing tool according to claim 4 in which said bearing stop means on said writing refill means is provided by said rotatable cam means integrally formed on said writing refill means.

6. The writing tool according to claim 1 in which said rotatable can means has a cavity; said cavity receiving the end of said writing refill means opposite said tip; said rotatable cam means and cam bar means having respective air vents open toward each other and outside air.

7. A reversible writing tool comprised of an outer sleeve, first and second head members attached to each end of said outer sleeve; first and second refillable writing means inserted in each end of said first and second head members and said outer sleeve; first and second return spring means in each of said first and second head members between a bearing stop on each of said first and second refillable writing means and an interior surface on each of said head members; first and second cam mechanism for projecting or retracting said first and second refillable writing means from the tip of said first and second head members each of said first and second cam mechanisms comprising; a cam body attached to the end of said head member opposite said tip, rotatable cam means inside said cam body surrounding said refillable writing means, rotation cam bar means for rotating said rotatable cam means surrounding said refillable writing means, said rotation cam bar means having a short portion inside said cam body engaging said rotatable cam means, said rotation cam bar means having an elongated cylindrical sleeve portion extending beyond the end of said cam body; said rotatable cam means and said rotation cam bar means being retained in said cam body by a shoulder on one end of said cam body and said bearing stop on said refillable writing means; a pair of elongate axial holes at each end of said outer sleeve near said head member and adjacent cam body; cam bar actuating means slidably mounted in each of said elongate axial holes; connecting means connecting each of said cam bar actuating means to said elongate cylindrical sleeve portion of each of said rotation cam bar means for actuating each of said rotation cam bar means for selectively extending or retracting a tip of one of said writing refill means; whereby a pair of cam mechanisms are built into each of said head members so that a writing tool on each end of said outer sleeve may be short in length.

* * * * *

UNITED STATES PATENT AND TRADEMARK OFFICE

CERTIFICATE OF CORRECTION

PATENT NO. : 5,184,908

DATED : February 9, 1993

INVENTOR(S) : TADASHI YAMAMOTO et al

It is certified that error appears in the above-indentified patent and that said Letters Patent is hereby corrected as shown below:

ON THE TITLE PAGE:

FOREIGN APPLICATION PRIORITY DATA

6 December 1989 (JP) JAPAN 1-141963

Signed and Sealed this

Fifteenth Day of August, 1995

Bruce Lehman

*Attest:*

BRUCE LEHMAN

*Attesting Officer*

*Commissioner of Patents and Trademarks*